US006098758A

United States Patent [19]

Gates

[11] Patent Number: 6,098,758

[45] Date of Patent: Aug. 8, 2000

[54] TOWER HOIST MECHANISM CONFINED WITHIN A TOWER INTERIOR

[75] Inventor: Frank V. Gates, Succasunna, N.J.

[73] Assignee: Lucent Technologies Inc., Murray Hill, N.J.

[21] Appl. No.: 09/198,102

[22] Filed: Nov. 23, 1998

[51] Int. Cl.[7] ..... B66B 9/02

[52] U.S. Cl. ..... 187/250; 187/271; 74/89.14

[58] Field of Search ..... 187/250, 267, 187/268, 271, 401, 403, 406, 414; 74/665 GD, 89.14

[56] References Cited

U.S. PATENT DOCUMENTS

| | | | |
|---|---|---|---|
| 828,029 | 8/1906 | Jackson | 187/271 |
| 1,576,266 | 3/1926 | Biggert, Jr. | 74/665 GD |
| 2,661,082 | 12/1953 | Ziegle | 187/250 X |
| 5,570,546 | 11/1996 | Butterworth et al. | 343/890 X |

FOREIGN PATENT DOCUMENTS

| | | | |
|---|---|---|---|
| 6-127872 | 5/1994 | Japan | 187/401 |
| 1263605 | 10/1986 | U.S.S.R. | 187/250 |
| 53546 | of 0000 | United Kingdom | 74/665 GD |

OTHER PUBLICATIONS 5 drawing figures, Jan. 1905.

*Primary Examiner*—Robert P. Olszewski
*Assistant Examiner*—Thuy V. Tran
*Attorney, Agent, or Firm*—David L. Davis

[57] ABSTRACT

A hoist mechanism for raising and lowering a platform within the interior of a tower and confined within the tower interior. In a first illustrative embodiment, a motor driven worm gear drives rubber coated wheels that are spring loaded to apply pressure to vertical tower members.

9 Claims, 5 Drawing Sheets

TOWER HOIST MECHANISM CONFINED WITHIN A TOWER INTERIOR

BACKGROUND OF THE INVENTION

This invention relates to a hoist mechanism for raising and lowering a platform within a tower and, more particularly, to such a hoist mechanism which is confined entirely within the interior of the tower structure.

Cellular telephone base stations typically have an electronics assembly mounted where it is readily accessible to a technician and one or more antennas mounted on an elevated structure to increase the line-of-sight range of the base station. Recently, a smaller cell site, called a microcell, has been developed to cover "hot spots" and "dead spots". The microcell uses less power and provides fewer channels than a "normal" cell site and was designed for a smaller coverage area. However, for some applications it would be advantageous to increase the coverage area of the microcell. Increased coverage area could be achieved by installing a more powerful radio frequency amplifier in the microcell. However, the size of the box containing the microcell is too small to accommodate the more powerful amplifier and to dissipate the additional heat generated thereby.

The increased coverage area could also be achieved by radiating from a taller tower, but if the cell site is at the base of the tower, significant losses occur in the cabling between the cell site and the antennas. In any event, the microcell antenna may be integrated with the electronics in the same box. Accordingly, it would be advantageous to locate the microcell at the top of the tower, since changing the elevation of the microcell from twenty feet to one hundred feet would increase the coverage area by a factor of about four. However, active electronics on the top of a tower need maintenance, so that the electronics either has to be lowered to a technician or the technician has to be raised to the electronics. It would be preferable to be able to raise and lower the electronics. This has been done in the past by using a cable and a winch with pulleys at the top of the tower and with the platform holding the electronics on the outside of the tower, along with the hoist mechanism. It would be desirable to contain the microcell and the hoist mechanism entirely within the confines of the tower interior for reasons of safety, structural integrity, esthetics, etc.

SUMMARY OF THE INVENTION

A combination according to the present invention includes a tower having an open interior and a communications network base station installed on a platform. Structure adapted to guide the platform within the tower interior during ascent and descent of the platform is also provided, along with a hoist mechanism contained within the tower interior and coupled to the platform for selectively effecting vertical movement of the platform.

Advantages of putting the microcell within the tower are:

If the microcell were to fall, it would be confined within the tower.

The center of gravity of the microcell can be located very near the center of the tower, reducing distortions on the tower.

If the hoist mechanism for raising and lowering the microcell is of the type utilizing cables, pulleys and winches, the "superstructure" for supporting the winch and pulley arrangement that lifts and lowers the microcell can be supported across members of the tower, rather than cantilivered off the edge, resulting in a less expensive installation.

The microcell can be constrained from "wobbling" as it moves up and down the tower by means of guides that are positioned against the ribs of the tower. If the microcell were supported external to the tower, added hardware would be needed to keep the microcell stable, thereby increasing the cost of the installation.

According to an aspect of the present invention, there is provided a hoist mechanism for use within a tower having an open interior defining a vertical longitudinal axis. The hoist mechanism comprises a plate which is situated within the tower interior and oriented in a plane orthogonal to the axis of the tower. A drive motor having an output shaft is secured to the plate and a drive gear is secured to the output shaft. A plurality of gear wheels engage the drive gear. A plurality of drive wheels, each corresponding to a respective one of the drive gears, are spaced substantially equiangularly about the axis. Each of the drive wheels is rotatable about a respective horizontal axis and engages a respective interior surface of the tower. A plurality of linkages each couples a respective one of the drive wheels to a respective one of the gear wheels.

In accordance with another aspect of this invention, the drive gear is a worm gear and each of the plurality of gear wheels is a respective worm wheel intermeshed with the worm gear.

In accordance with another aspect of this invention, a plurality of first sprocket wheels is each fixedly secured coaxially to a respective one of the gear wheels and a plurality of second sprocket wheels is each fixedly secured coaxially to a respective one of the drive wheels. Each of the plurality of linkages comprises a chain coupling a respective first sprocket wheel to a respective second sprocket wheel.

In accordance with a further aspect of this invention, each of the drive wheels frictionally engages the respective interior surface of the tower. A plurality of spring members is each adapted to provide a normal force for a respective drive wheel against the respective interior surface of the tower.

BRIEF DESCRIPTION OF THE DRAWINGS

The foregoing will be more readily apparent upon reading the following description in conjunction with the drawings wherein like elements in different figures thereof are identified by the same reference numeral and wherein.

DETAILED DESCRIPTION

Figure 1:
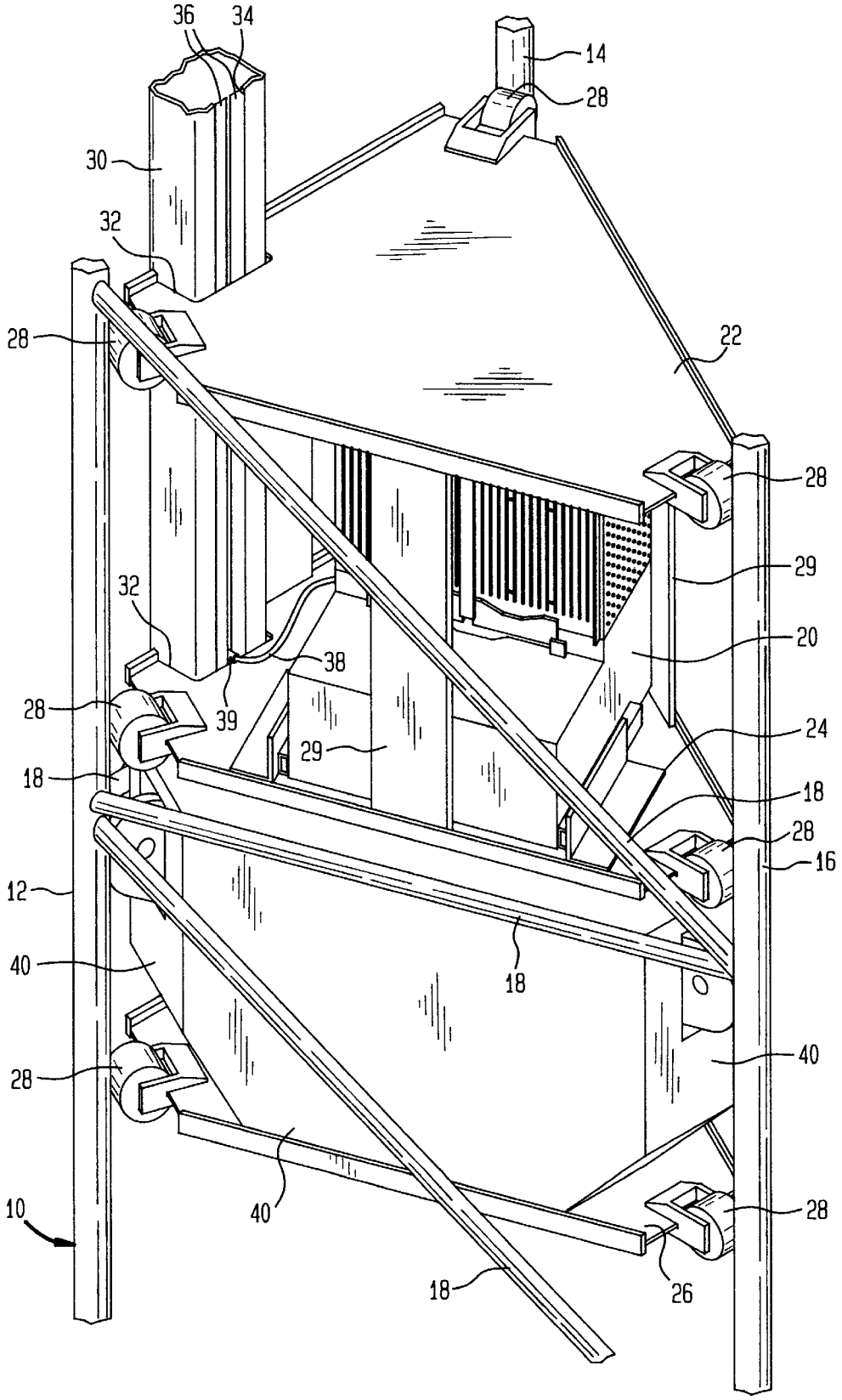
FIG. 1 is a perspective view showing a portion of a latticework tower containing an illustrative embodiment of a hoist mechanism constructed according to the present invention.
Figure 2:
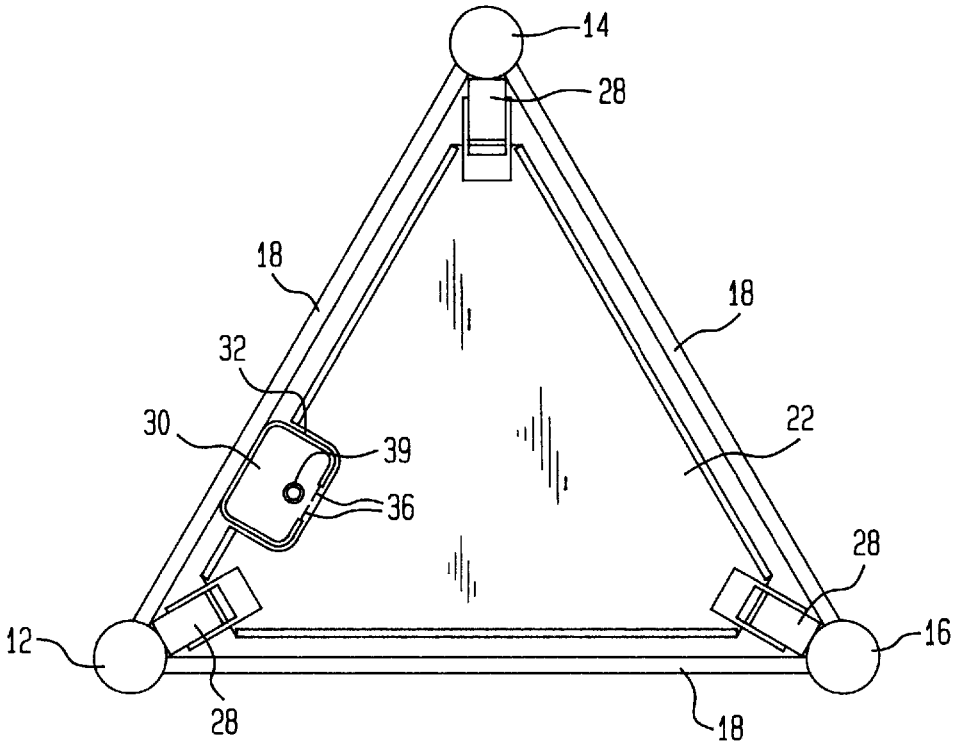
FIG. 2 is a top plan view of the top guide plate within the tower, as shown in FIG. 1.

Referring now to the drawings, FIG. 1 shows a portion of a tower, designated generally by the reference numeral 10, in which is installed a hoist constructed according to the present invention. Illustratively, the tower 10 is a three-sided (i.e., triangular) latticework tower having three vertically oriented members 12, 14, 16 which are interconnected by a plurality of transverse braces 18. Although the tower 10 is shown as being triangular, other multi-sided towers can be utilized when practicing the present invention. In all cases, the braces would interconnect adjacent ones of the vertically oriented members of the tower, so that the interior of the tower is open.

The microcell 20 is secured between a top guide plate 22 and a middle guide plate 24, with the inventive hoist mechanism being secured between the middle guide plate 24 and a bottom guide plate 26. Each of the guide plates 22, 24, 26 is generally planar and polygonal with as many sides and vertices as there are vertically oriented members 12, 14, 16 of the tower 10. Each of the vertices of the plates 22, 24, 26 is adjacent a respective vertically oriented member 12, 14, 16, and a plurality of guide rollers 28 are each journalled for rotation to a respective guide plate vertex. Each of the guide rollers 28 engages a respective vertically oriented member 12, 14, 16 which is adjacent the respective vertex. A plurality of support members 29 hold the guide plates 22, 24 in parallel spaced relation a sufficient distance apart that the microcell 20 can be installed therebetween.

A vertically extending cable duct 30 is secured to braces 18 defining one side of the tower 10 and the plates 22, 24, 26 are each formed with a notch 32 for receiving the duct 30. The cable duct 30 has an opening 34 on its inner side, with the opening 34 being partially closed by a pair of flexible flaps 36. Thus, a cable 38 containing signal lines and power lines for the microcell 20 and the hoist mechanism (to be described hereinafter) can pass through the flaps 36 into the interior of the duct 30. Accordingly, as the microcell 20 moves up and down the tower 10, the cable 38 can either be piled up at the bottom of the duct (when the microcell 20 descends) or extend along the duct 30 (when the microcell 20 ascends).

The cable duct 30 keeps the cable 38 out of the way and prevents wind from moving the cable when the hoist mechanism is elevated. The size of the duct 30 must be sufficient to allow the cable 38 to fall and not bind. An arm 39 projects from the middle guide plate 24 through the flaps 36 and the cable 38 hangs from the arm 39. As the hoist mechanism descends, the cabling piles up on the ground. The lower end of the duct 30 is preferably approximately two feet above the ground and is flared to allow the cable 38 to enter as the hoist mechanism ascends.

Figure 3:
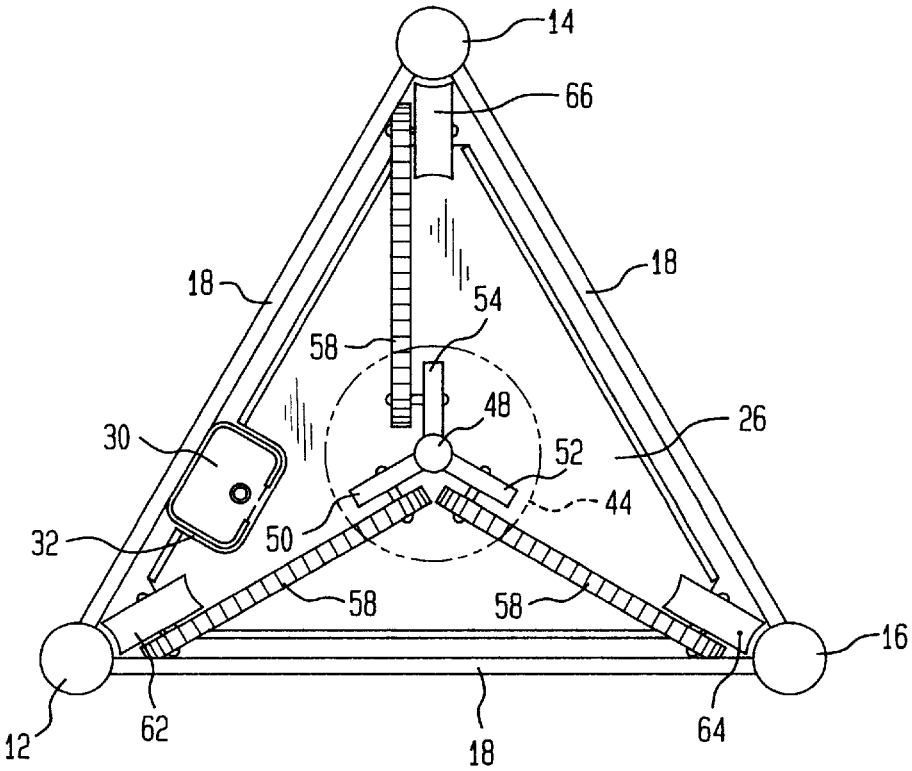
FIG. 3 is a schematic plan view of the hoist mechanism taken below the middle guide plate shown in FIG. 1.
Figure 4:
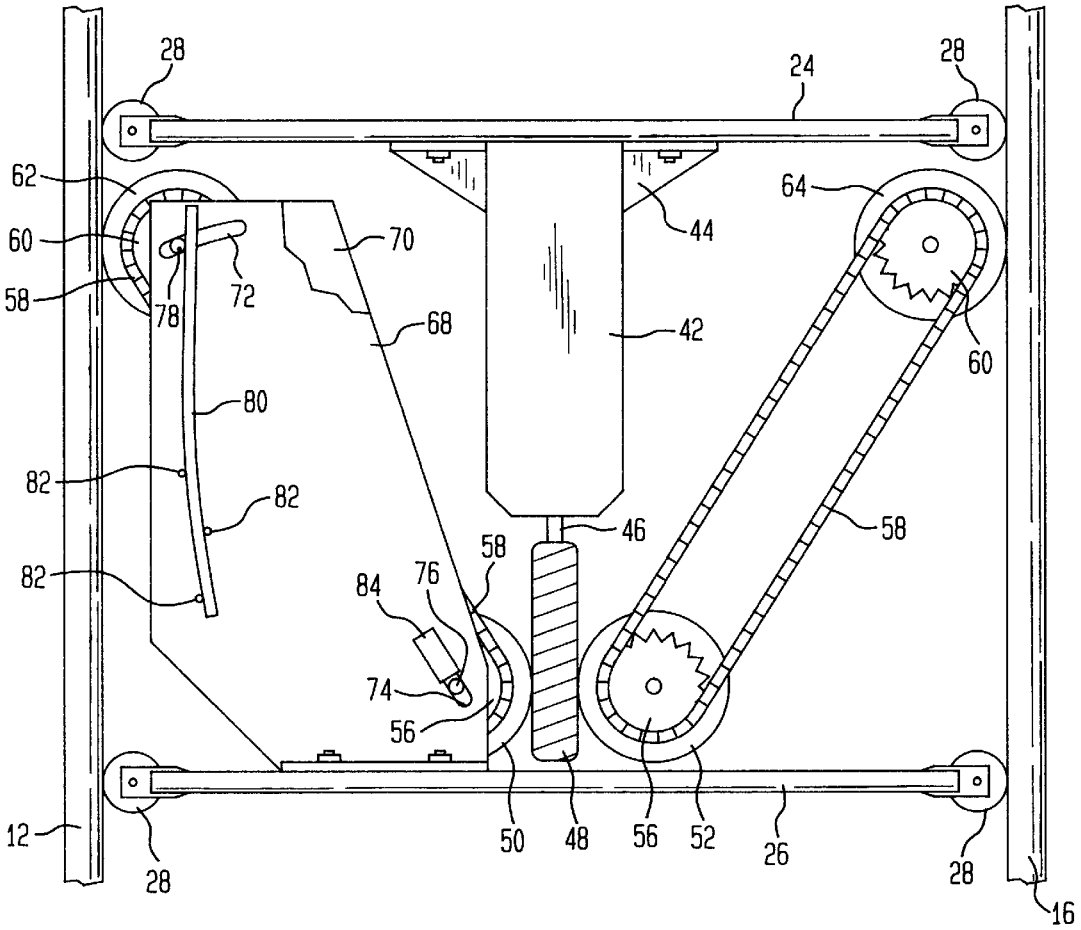
FIG. 4 is a schematic elevational view illustrating the illustrative embodiment of the hoist mechanism according to the present invention.

Preferably, the inventive hoist mechanism is contained within covers 40 (FIG. 1), but for ease of illustration, the covers are not shown in FIGS. 3 and 4. In addition to covering the hoist mechanism, the covers 40 also serve to secure together the guide plates 24 and 26.

In summary, the inventive hoist mechanism uses a motor to drive a plurality of wheels, each of which frictionally engages a respective vertical tower member. The motor is controllable, illustratively in the same manner as a remote controlled garage door opener, to move the wheels in either a first or a second direction to selectively cause the microcell to either ascend or descend the tower.

As is clearly shown in FIGS. 3 and 4, the inventive hoist mechanism includes a drive motor 42 secured to the middle guide plate 24, illustratively by the bracket 44. The guide motor 42 extends downwardly and is arranged with its output shaft 46 having a vertical axis disposed centrally within the tower 10. A drive gear, illustratively a worm gear 48, is secured to the output shaft 46 for rotation therewith. A plurality of gear wheels, illustratively worm wheels 50, 52, 54, engage the worm gear 48. Preferably, there is one worm wheel associated with each of the vertically oriented members 12, 14, 16. A sprocket wheel 56 is mounted coaxially with each of the worm wheels 50, 52, 54, for rotation therewith. A chain 58 engages each of the sprocket wheels 56. At the other end of each chain 58 is a second sprocket wheel 60 also engaged by the chain 58. Mounted coaxially to each sprocket wheel 60 is a respective drive wheel 62, 64, 66. Each of the drive wheels 62, 64, 66 frictionally engages a respective one of the vertically oriented members 12, 14, 16. Preferably, the drive wheels 62, 64, 66 are coated with rubber or some other material having a high coefficient of friction.

To hold each of the drive assemblies (i.e., worm wheel, drive wheel, sprocket wheels and chain), there is provided a pair of parallel planar support plates 68, 70 flanking the drive assembly and secured to the bottom guide plate 26. For reasons of clarity, only one such pair of support plates 68, 70 is shown in FIG. 4 and none are shown in FIG. 3. Each of the support plates 68, 70 has a first elongated slot 72 extending transversely to the respective vertical tower member and a second elongated slot 74 extending transversely to the elongated slot 72. The worm wheel 60 and associated sprocket wheel 56 have their common axle 76 journalled for rotation in the pair of slots 74 and the drive wheel 62 and associated sprocket wheel 60 have their common axle 78 journalled for rotation in the slot 72. Mounted to each of the support plates 68, 70 is a respective spring member 80, illustratively a leaf spring cantilevered from the pins 82 at one end and having its other end bearing against the axle 78 to provide a normal force for the drive wheel 62 against the vertical tower member 12. An advantage of this arrangement is that the mechanism can accommodate tapered tower structures, which are quite common, as long as the extent of the taper is within the limits of the length of the slot 72. Associated with the slot 74 and engaging the axle 76 is a chain tension adjuster 84 which can be selectively manipulated to move the axle 76 along the slot 74 so that the chain 58 has the proper tension for interconnecting the sprocket wheels 56, 60 for concurrent rotation.

An advantage of using the worm gear 48 attached to the output shaft 46 of the motor 42 is that it acts as a brake when the motor is unpowered.

Figure 5:
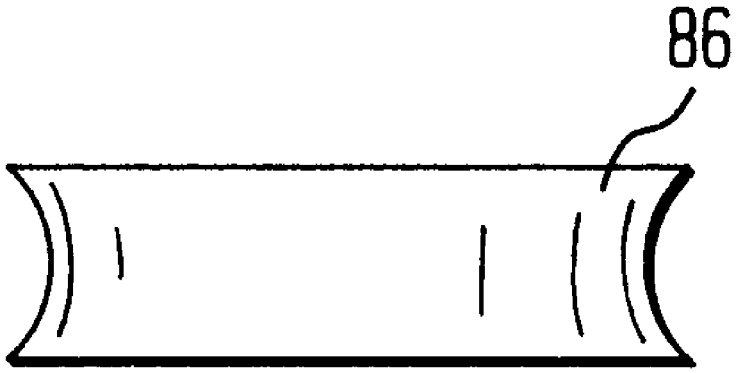
FIGS. 5 and 6 illustrate possible drive wheel shapes for differently shaped vertically oriented tower members.
Figure 6:
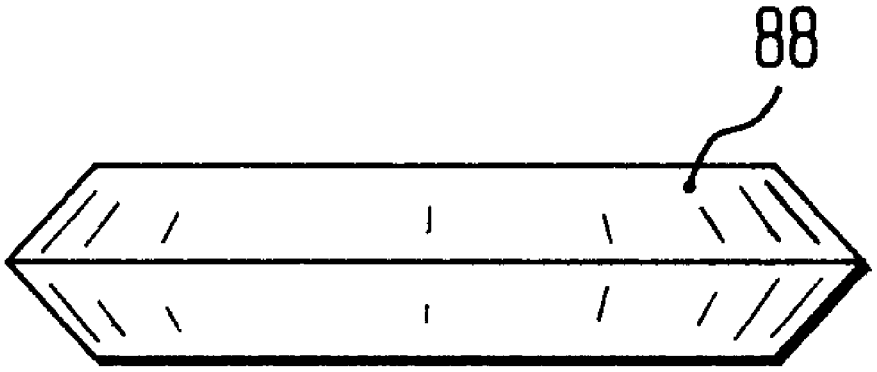

Differently shaped vertical tower members would require differently shaped wheels. Thus, as shown in FIG. 5, if the vertical tower members are round, a drive wheel 86 such as shown in FIG. 5 having a concave outer periphery would be appropriate. The drive wheel 88 shown in FIG. 6 would work where the vertical tower members are channels. Various other designs would be appropriate for different shapes of vertical tower members.

In the aforedescribed illustrative embodiment, the drive wheels have been described as engaging the vertical tower members at the vertices of the guide plates. It is understood that the tower may have vertical members extending along the sides of the guide plates and for such a tower the drive wheels could be repositioned to the sides of the guide plates.

Figure 7:
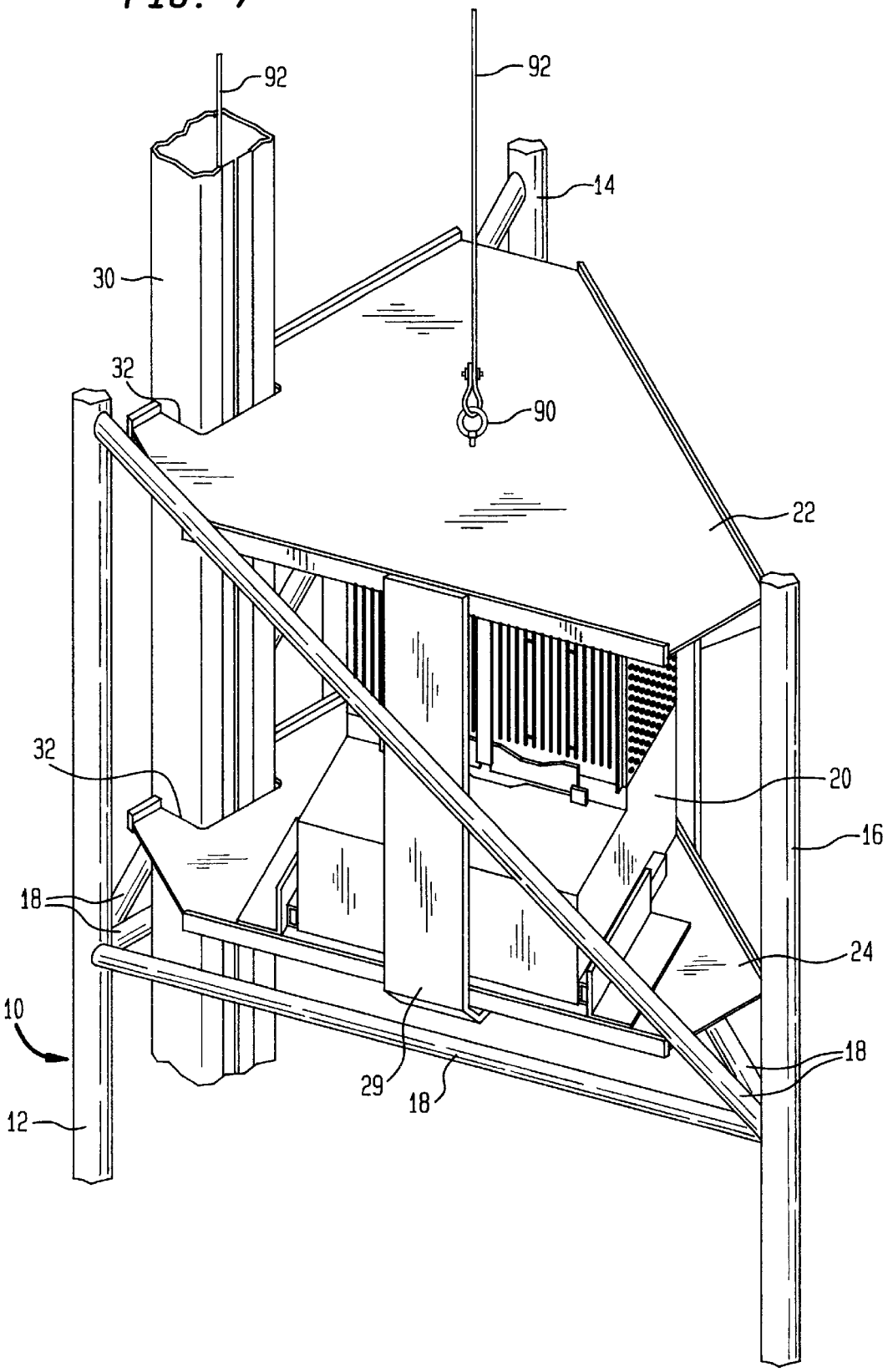
FIG. 7 is a perspective view showing a communications network base station and a cable hoist confined within a tower interior, in accordance with another embodiment of the present invention.

FIG. 7 illustrates how the principles of this invention are applied to a communications network base station which is raised and lowered by a lift cable attached to a motor driven winch. Thus, the microcell 20 is secured between the plates 22 and 24 making up the platform. A retainer ring 90 is secured to the plate 22 in a conventional manner. Illustratively, the ring 90 is part of an eye bolt secured to the plate 22 by nuts (not shown). A lift cable 92 has one end secured to the ring 90 and extends over pulleys (not shown) at the top of the tower 10. The cable 92 then goes to the bottom of the tower 10 within the duct 30. At the bottom of the tower 10, the other end of the cable 92 is secured to a motor driven winch. Thus, the entire platform holding the communications network base station and the hoist mechanism are contained within the interior of the tower.

Accordingly, there has been disclosed a hoist mechanism which is confined entirely within the interior of a tower and which is effective for raising and lowering a platform within the tower. While illustrative embodiments of the present invention have been disclosed herein, it is understood that various modifications and adaptations to the disclosed embodiments are possible. Thus, while a latticework tower has been described herein, it will be appreciated that the present invention is adaptable for use with other types of towers having an open interior, such as, for example, a monopole tower. Further, while a particular hoist mechanism has been disclosed in detail, the present invention contemplates its application to any communications network base station arranged for selective raising and lowering all within the confines of a tower interior, including those hoist mechanisms which utilize cables, pulleys and winches. It is therefore intended that this invention be limited only by the scope of the appended claims.

What is claimed is:

1. A hoist mechanism for use within a tower having an open interior defining a vertical longitudinal axis, the hoist mechanism comprising:

a first plate within the tower interior and oriented in a plane orthogonal to said axis;

a drive motor secured to said first plate, said drive motor having an output shaft;

a drive gear secured to said output shaft;

a plurality of gear wheels engaging said drive gear;

a plurality of drive wheels each corresponding to a respective one of said gear wheels, said plurality of drive wheels being spaced substantially equiangularly about said axis, each of said drive wheels being rotatable about a respective horizontal axis and engaging a respective interior surface of said tower; and a plurality of linkages each coupling a respective one of said drive wheels to a respective one of said gear wheels.

2. The hoist mechanism according to claim 1 wherein:

said drive gear comprises a worm gear; and each of said plurality of gear wheels comprises a respective worm wheel intermeshed with said worm gear.

3. The hoist mechanism according to claim 1 further comprising:

a plurality of first sprocket wheels each fixedly secured coaxially to a respective one of said gear wheels; and a plurality of second sprocket wheels each fixedly secured coaxially to a respective one of said drive wheels;

wherein each of said plurality of linkages includes a chain coupling a respective first sprocket wheel to a respective second sprocket wheel.

4. The hoist mechanism according to claim 1 wherein each of said drive wheels frictionally engages the respective interior surface of the tower and said hoist mechanism further comprises;

a plurality of spring members each adapted to provide a normal force for a respective drive wheel against the respective interior surface of the tower.

5. The hoist mechanism according to claim 4 further comprising for each set of a gear wheel and a drive wheel:

a pair of parallel planar support plates flanking said set and secured orthogonally to one of said guide plates, each of said support plates having a first elongated slot extending transversely to the respective vertically oriented member;

wherein the drive wheel of said each set has an axle journalled for rotation in the first elongated slots of the support plates; and wherein the respective spring member includes a leaf spring mounted at a first end to one of the support plates with its other end engaging the axis of the drive wheel of said each set to bias the drive wheel of said each set along the elongated slots toward the respective interior surface of the tower.

6. The hoist mechanism according to claim 5 further comprising:

a plurality of first sprocket wheels each fixedly secured coaxially to a respective one of said gear wheels; and a plurality of second sprocket wheels each fixedly secured coaxially to a respective one of said drive wheels;

wherein each of said plurality of linkages comprises a chain coupling a respective first sprocket wheel to a respective second sprocket wheel; and wherein each of said support plates has a second elongated slot extending transversely to the respective first elongated slot, the gear wheel of said each set has an axle journalled for rotation in the second elongated slots of the support plates, and the hoist further includes a pair of chain tension adjusters each mounted to a respective support plate adjacent a respective second elongated slot and coupled to the axle of the gear wheel of said each set and adapted for selective manipulation to move the axle of the gear wheel of said each set along the second elongated slots.

7. The hoist mechanism according to claim 1 further comprising:

a cable coupled at a first end to the drive motor and of sufficient length to reach the ground when the hoist mechanism is at its highest elevation within the tower;

a cable duct secured within the interior of the tower and extending up the tower adjacent the travel range of the hoist mechanism, the cable duct having an elongated opening along its length and facing the hoist mechanism, the cable duct having a flexible flap secured along one edge of the elongated opening; and an arm secured to the hoist mechanism and extending through the elongated slot into the interior of the cable duct;

wherein the cable is secured to the arm.

8. The hoist mechanism according to claim 1 wherein:

the tower includes at least three vertically oriented members and a plurality of transverse braces interconnecting adjacent ones of the vertically oriented members; and each of said drive wheels engages a respective one of said vertically oriented tower members.

9. The hoist mechanism according to claim 8 wherein said first plate is generally polygonal with as many sides and vertices as there are vertically oriented tower members, with each of the vertices being adjacent a respective vertically oriented tower member, the hoist mechanism further comprising:

a second generally polygonal plate having as many sides and vertices as there are vertically oriented members of the tower, with each of the vertices being adjacent a respective vertically oriented member, said second plate being parallel to said first plate and being secured in spaced relation to said first plate;

a plurality of guide rollers each journalled for rotation to a respective first and second plate vertex and each engaging a respective vertically oriented tower member which is adjacent the respective first and second plate vertex.

* * * * *